United States Patent [19]

Hippely et al.

[11] Patent Number: 4,917,643

[45] Date of Patent: Apr. 17, 1990

[54] TOY VEHICLE WITH THERMOCHROMIC MATERIAL

[75] Inventors: Keith Hippely, Manhattan Beach; Larry R. Wood, Redondo Beach, both of Calif.

[73] Assignee: Mattel, Inc.

[21] Appl. No.: 67,519

[22] Filed: Jun. 26, 1987

[51] Int. Cl.[4] ..... A63H 17/00

[52] U.S. Cl. ..... 446/14; 106/21

[58] Field of Search ..... 446/14, 219, 465; 427/148; 106/21

[56] References Cited

U.S. PATENT DOCUMENTS

| | | | |
|---|---|---|---|
| 2,656,647 | 10/1953 | Schepp . | |
| 2,921,407 | 1/1960 | Wagner et al. . | |
| 3,262,386 | 7/1966 | Gordon . | |
| 3,382,607 | 5/1968 | Ryan et al. | 446/296 |
| 3,451,143 | 6/1969 | Thomas et al. . | |
| 3,617,324 | 11/1971 | Thomas . | |
| 3,655,256 | 11/1972 | Claytor et al. . | |
| 3,831,165 | 8/1974 | Chivian et al. . | |
| 3,980,300 | 9/1976 | Hornsby, Jr. | 273/58 B |
| 4,028,118 | 6/1977 | Nakasuji et al. . | |
| 4,134,853 | 1/1979 | Ehrlich et al. | 252/600 |
| 4,215,208 | 7/1980 | Yee et al. . | |
| 4,421,560 | 12/1983 | Kito et al. | 106/21 |
| 4,425,161 | 1/1984 | Shibahashi et al. | 427/148 X |
| 4,444,819 | 4/1984 | Maruta et al. | 503/209 |
| 4,462,616 | 7/1984 | Shanton | 503/210 |
| 4,554,565 | 11/1985 | Kito et al. . | |
| 4,560,604 | 12/1985 | Shimizu et al. | 428/87 |
| 4,567,019 | 1/1986 | Lawton | 422/57 |
| 4,611,072 | 9/1986 | Nachbur et al. | 556/135 |
| 4,674,985 | 6/1987 | Orenstein et al. | 446/14 |
| 4,681,791 | 7/1987 | Shibihashi et al. . | |
| 4,720,301 | 1/1988 | Kito et al. . | |

FOREIGN PATENT DOCUMENTS

| | | |
|---|---|---|
| 2584492 | 2/1987 | France . |
| 2066089 | 7/1981 | United Kingdom . |

*Primary Examiner*—Richard J. Johnson
*Assistant Examiner*—Sam Rimell
*Attorney, Agent, or Firm*—Poms, Smith, Lande & Rose

[57] ABSTRACT

A toy vehicle spray painted with paint containing thermochromic material which changes color as the temperature of the vehicle varies. Selected portions of the toy vehicle may be painted with the thermochromic material to provide a variety of patterns, designs, numbers, letters or other indicia which change color in response to temperature variations. In addition, different portions of the toy vehicle may be painted with different paints containing different color thermochromic materials.

19 Claims, 1 Drawing Sheet

14
10
14
12
14

10

16
16
12

10
12
CAB
18

10
23
12
20

24
28

10
22
26
12

TOY VEHICLE WITH THERMOCHROMIC MATERIAL

BACKGROUND OF THE INVENTION

The present invention relates generally to toy vehicles and, more particularly, to a toy vehicle painted with a paint containing thermochromic material which changes color as the temperature of the vehicle varies.

In the past, a variety of toys have been developed with color-changing features using thermochromic or light-sensitive materials embedded or mixed in plastic, printed on paper or plastic, or impregnated in fibers used for clothing, doll hair, plush figures, or the like. For example, U.S. Pat. Nos. 4,560,604 issued to Shimizu, et al on Dec. 24, 1985 (coating fibers used for stuffed toys with thermochromic material); 4,134,853 issued to Ehrlich, et al on Jan. 16, 1979 (photochromic composition combined with moldable materials for forming toys); and 3,980,300 issued to Hornsby, Jr. on Sept. 14, 1976 (layer of liquid crystalline material used for ball) which disclose the use of such materials in toys. British Patent No. GB 2,066,089A issued to Rickson on July 8, 1981 describes the use of temperature-sensitive cholesteric liquid crystal material for changing the color of the eyes of a doll. U.S. Pat. No. 3,382,607 issued to Ryan, et al on May 14, 1968 discloses a figure toy having synthetic hair fibers impregnated with an indicator dye which changes color in response to contact with liquids of different pH concentrations.

Thermochromic materials are disclosed in U.S. Pat. Nos. 4,567,019 issued to Lawton on Jan. 28, 1986 and 4,421,560 issued to Kito, et al on Dec. 20, 1983. Heat-sensitive recording materials are described in U.S. Pat. Nos. 4,611,072 issued to Nachbur, et al; 4,462,616 issued to Shanton on July 31, 1984; and 4,444,819 issued to Maruta, et al.

None of the above patents discloses a toy vehicle painted with a paint containing thermochromic material which is capable of changing color as the temperature of the vehicle varies. Since the toy vehicle is painted, such a toy vehicle, especially a miniature die-cast vehicle, provides numerous play options. For example, a child could pretend that such a toy vehicle is being painted by immersing it in heated or cold water causing the color of the vehicle to change. A child could also vary the color of such a vehicle using heated or cold air, ice, heated pens, heated brushes, light bulbs, heat blankets, or the heat of his or her hands The toy vehicle could be made out of any material such as metal or plastic. Accordingly, there is a need in the toy manufacturing arts for such a toy vehicle.

SUMMARY OF THE INVENTION

It is an object of this invention to provide a toy vehicle painted with paint containing thermochromic material which changes color as the temperature of the vehicle varies.

It is another object of this invention to provide a toy vehicle which is spray painted with paint containing thermochromic material.

It is still another object of this invention to provide a toy vehicle having only portions thereof spray painted with paint containing thermochromic material to produce a variety of patterns, designs, numbers, letters or other indicia which change color as the temperature of the vehicle varies.

It is still another object of this invention to provide a toy vehicle having different portions thereof spray painted with different paints containing different colored thermochromic materials which change color as the temperature of the vehicle varies.

These and other objects and advantages are attained by a toy vehicle spray painted with paint containing thermochromic material which changes color as the temperature of the vehicle varies. Selected portions of the toy vehicle may be painted with the paint containing thermochromic material to provide a variety of patterns, designs, numbers, letters, or other indicia which change color in response to temperature variations. In addition, different portions of the toy vehicle may be painted with different paints containing different colored thermochromic materials.

The various features of the present invention will be best understood together with further objects and advantages by reference to the following description of the preferred embodiments taken in connection with the accompanying drawings.

DESCRIPTION OF THE PREFERRED EMBODIMENTS

The following specification taken in conjunction with the drawings sets forth the preferred embodiments of the present invention in such a manner that any person skilled in the toy manufacturing arts can use the invention. The embodiments disclosed herein are the best modes contemplated by the inventors for carrying out their invention in a commmercial environment although it should be understood that various modifications can be accomplished within the parameters of the present invention.

Figure 1:
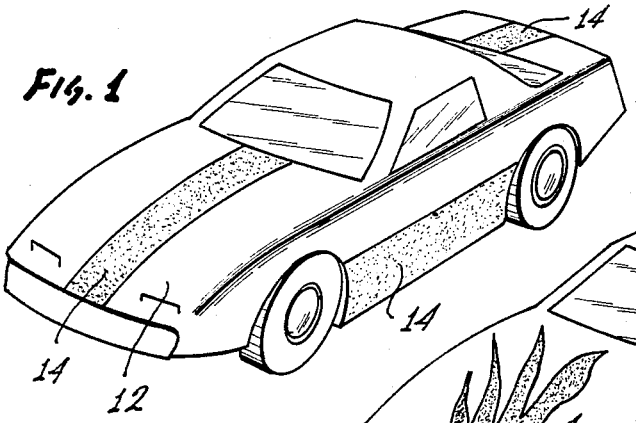
FIG. 1 is a perspective view of a toy vehicle of the present invention having portions thereof painted with paint containing thermochromic material.
Figure 2:
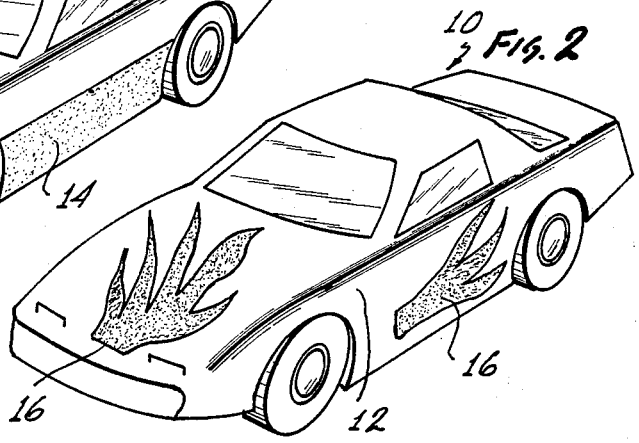
FIGS. 2 through 4 are perspective views of other embodiments of the toy vehicle of the present invention having different portions thereof painted with paint containing thermochromic material to provide a variety of patterns, designs, numbers, letters or other indicia.

Referring now to the drawings and particularly to FIG. 1, a toy vehicle 10 of the present invention having a body 12 is disclosed. The body 12 is painted with paint containing thermochromic material at portions thereof to provide a pattern or stripes 14 as illustrated. Alternatively, the body 12 may be painted with thermochromic material at different portions thereof to provide a variety of designs 16, letters 18, numbers 20 or other indicia (not shown) as illustrated in FIGS. 2 though 4. In addition, the entire body 12 may be painted with paint containing thermochromic material if desired (not shown). It is important to point out that any portion or all of the body 12 may be painted with paint containing thermochromic material to provide any desirable design, pattern, number, letter or indicia.

Figure 5:
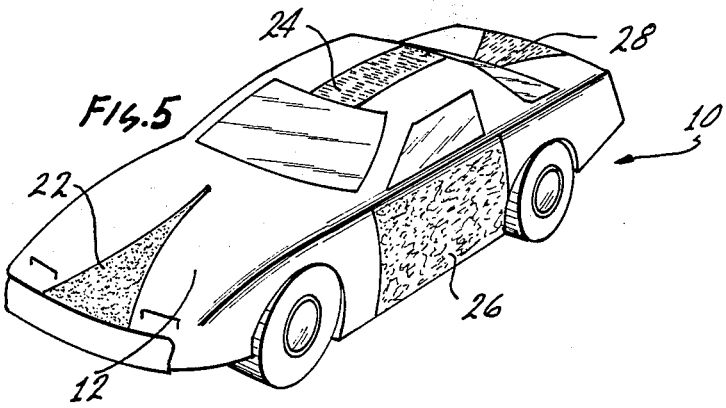
FIG. 5 is a perspective view of another embodiment of the toy vehicle of the present invention having different portions thereof painted with different paints containing different colored thermochromic materials.

FIG. 5 shows another embodiment of the toy vehicle 10. The body 12 of the vehicle 10 has different portions 22 through 28 thereof painted with different paints containing different colored thermochromic materials so that each portion has a different colored thermochromic material. Alternatively, some of the portions 22 through 28 may have the same colored thermochromic material. As another alternative, the thermochromic materials of one or some of the portions 22 through 28 may change color at different temperatures.

Since the thermochromic material will change color as the temperature of the body 12 changes, a child may vary the appearance or color of the toy vehicle 10 by raising or lowering the temperature of the body 12. This may be accomplished by immersing the toy vehicle 10 in heated or cold water, or using heated or cold air, ice, heated pens, heated brushes, light bulbs, heat blankets, etc., to change the temperature of the body 12. The heat of a child's hands may also be used to change the temperature of the body 12 and, thus, change the color of the thermochromic material. Generally, thermochromic material changes color from a darker color to a lighter color as the temperature of the material is increased.

Figure 3:
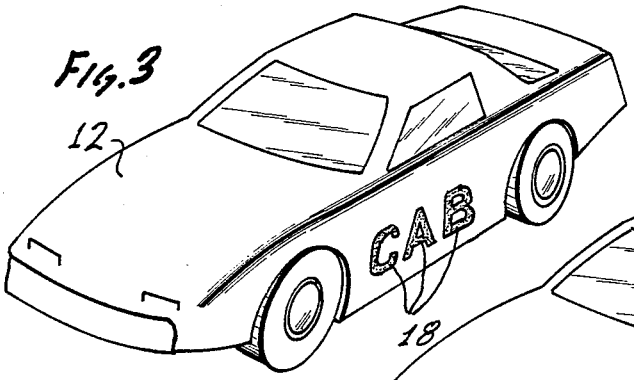
Figure 4:
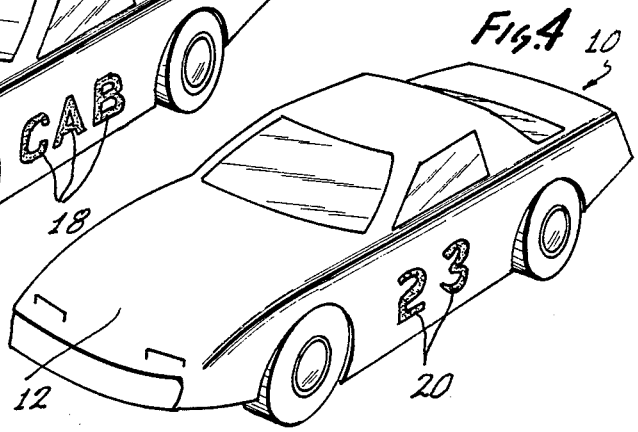

Dramatic results may be obtained by changing the temperature of the body 12 or thermochromic material. For example, as the temperature changes the toy vehicle 10 shown in FIG. 3 changes from a private vehicle to a cab, or vice versa. Numerous other changes are possible such as changing a private vehicle into a police car, ambulance, etc. A particularly dramatic result is obtained if the color of the toy vehicle 10 changes from a color such as brown which may be used to simulate a "dirty look" to a lighter, brighter, or clear color to simulate a "clean look", thus simulating washing the toy vehicle 10. This may be accomplished by using a brown-colored thermochromic material which becomes clear or transparent as the temperature of the material or body 12 is heated to a certain temperature level revealing an underlying coat of paint (or color) which does not contain thermochromic material. The same result can be obtained by using a thermochromic material which changes from a brown color to a lighter color as the temperature increases.

The body 12 may be made out of any material such as metal or plastic. However, a miniature metal die-cast body 12 is preferable because a metal vehicle will stay warm or cold longer and, thus, retain its color longer than a plastic vehicle.

The body 12 of the toy vehicle 10 is preferably spray painted with a paint containing thermochromic material. Alternatively, the toy vehicle 10 may be painted with a paint containing thermochromic material by dipping the vehicle in the paint, using a brush to paint the vehicle, or using any other technique. The word "painted" as used herein is intended to include any means of coating the body 12 of the toy vehicle 10 with a paint containing thermochromic material. Likewise, the word "paint" as used herein is intended to include any material containing thermochromic material that is coated to the body 12 of the toy vehicle 10. Because the paint containing thermochromic material is painted onto the body 12, the color of the toy vehicle 10 is brighter than that of a vehicle made out of molded plastic material containing thermochromic material. In addition, a toy metal vehicle spray painted with thermochromic material will retain its color longer, or stay warm or cold longer, than a vehicle made out of molded thermochromic plastic material.

The thermochromic material sprayed onto the body 12 is preferably thermochromic paint sold by Matsui Shikiso Chemical Co., Ltd., Kyoto, Japan, under the trademark Chromic Epoxy Spray Paint. The composition of the thermochromic paint sold under the above trademark is a trade secret of Matsui Shikiso Chemical Co., Ltd. However, this thermochromic paint contains microencapsulated thermochromic material mixed or blended with an epoxy resin material, a hardening agent such as that sold by the above-mentioned company under the trademark Chromic Epoxy Fixer and a diluting solvent such as Xylol (Xylene). The Chromic Epoxy Spray Paint has nine base colors: yellow, gold orange, vermilion, pink, fast blue, turquoise blue, green, brown and black. Matsui Shikiso Chemical Co., Ltd., has developed a method of spray painting the Chromic Epoxy Spray Paint onto a toy vehicle by spraying a first coat of the thermochromic paint onto the vehicle followed by heat treatment at 140° C. for 5 minutes, and then spraying a second coat of the thermochromic paint followed by heat treatment at 140° C. for 20 minutes. However, any number of coats (including only one coat) of thermochromic paint may be used and the heat treatment can be varied or eliminated if desired. It is important to note that any other type of thermochromic paint may be used instead of the above-mentioned Chromic Epoxy Spray Paint and any color paint or thermochromic material may be used. Also, the temperature ranges during which the thermochromic materials change color can be selected as desired.

The above description discloses the preferred embodiments of the present invention. However, persons of ordinary skill in the toy field are capable of numerous modifications once taught these principles. Accordingly, it will be understood by those skilled in the art that changes in form and details may be made to the above-described embodiments without departing from the spirit and scope of the invention.

We claim:

1. A toy vehicle comprising a vehicle body having an initial appearance resulting from at least a portion of said vehicle body being coated with thermochromic paint means having an initial color, said thermochromic paint means for changing said initial appearance by changing said initial color in response to temperature variation of said vehicle body, said thermochromic paint means including thermochromic material capable of changing color due to said temperature variation in order to vary said initial appearance of said vehicle body to a substantially different appearance.

2. The toy vehicle of claim 1 wherein said thermochromic paint means comprises thermochromic paint containing said thermochromic material painted onto said body.

3. The toy vehicle of claim 2 wherein substantially all of said vehicle body is painted with said thermochromic paint.

4. The toy vehicle of claim 3 wherein the appearance is changed from an opaque dirty car to a transparent clean car and vice versa.

5. The toy vehicle of claim 2 wherein substantially all of said vehicle body is coated with said thermochromic paint containing said thermochromic material.

6. The toy vehicle of claim 1 wherein said thermochromic material changes color from a colored opaque material resembling a dirty car to a transparent material resembling a clean car.

7. The toy vehicle of claim 1 wherein said vehicle body is made out of metal.

8. The toy vehicle of claim 1 wherein said vehicle body is made out of plastic.

9. A toy vehicle comprising a vehicle body having an initial appearance resulting from at least a portion of said vehicle body being coated with thermochromic paint means forming a design having an initial color, said thermochromic paint means for changing said initial appearance by changing said initial color of said design in response to temperature variation of said vehicle body, said thermochromic paint means including thermochromic material capable of changing color due to said temperature variation in order to vary said initial appearance of said vehicle body to a substantially different appearance.

10. A toy vehicle comprising a vehicle body having an initial appearance resulting from at least a portion of said vehicle body being coated with thermochromic paint means forming at least one letter having an initial color, said thermochromic paint means for changing said initial appearance by changing said initial color of said letter in response to temperature variation of said vehicle body, said thermochromic paint means including thermochromic material capable of changing color due to said temperature variation in order to vary said initial appearance of said vehicle body to a substantially different appearance.

11. A toy vehicle comprising a vehicle body having an initial appearance resulting from at least a portion of said vehicle body being coated with thermochromic paint means forming at least one number having an initial color, said thermochromic paint means for changing said initial appearance by changing said initial color of said number in response to temperature variation of said vehicle body, said thermochromic paint means including thermochromic material capable of changing color due to said temperature variation in order to vary said initial appearance of said vehicle body to a substantially different appearance.

12. A toy vehicle comprising a vehicle body having an initial appearance resulting from (a) a first portion of said vehicle body being coated with a first thermochromic paint means for changing said initial appearance in response to temperature variation of said vehicle body, said first thermochromic paint means including a first thermochromic material, and (b) a second portion of said vehicle body being coated with a second thermochromic paint means for changing said initial appearance in response to temperature variation of said vehicle body, said second thermochromic paint means including a second thermochromic material, said first and second thermochromic materials capable of changing color due to said temperature variation from a first color at a first temperature to a second color at a second temperature in order to vary said initial appearance of said vehicle body to a substantially different appearance.

13. The toy vehicle of claim 12 wherein said first and second thermochromic materials have different first colors.

14. The toy vehicle of claim 13 wherein said first and second thermochromic materials change color to different second colors at different second temperatures.

15. The toy vehicle of claim 13 wherein said first and second thermochromic materials change color to different second colors at about the same second temperature.

16. The toy vehicle of claim 12 wherein said first thermochromic material changes color from a colored opaque material to a transparent material.

17. The toy vehicle of claim 12 wherein said first and second thermochromic materials have the same first color.

18. The toy vehicle of claim 17 wherein said first and second thermochromic materials change color to different second colors at different second temperatures.

19. The toy vehicle of claim 17 wherein said first and second thermochromic materials change color to different second colors at about the same second temperature.

* * * * *

US004917643C1

(12) EX PARTE REEXAMINATION CERTIFICATE (4885th)

United States Patent

Hippely et al.

(10) Number: US 4,917,643 C1

(45) Certificate Issued: Dec. 16, 2003

(54) TOY VEHICLE WITH THERMOCHROMIC MATERIAL

(75) Inventors: Keith Hippely, Manhattan Beach, CA (US); Larry R. Wood, Redondo Beach, CA (US)

(73) Assignee: Mattel, Inc., Hawthorne, CA (US)

Reexamination Request:
No. 90/004,769, Sep. 29, 1997

Reexamination Certificate for:

| | |
|---|---|
| Patent No.: | **4,917,643** |
| Issued: | **Apr. 17, 1990** |
| Appl. No.: | **07/067,519** |
| Filed: | **Jun. 26, 1987** |

(51) Int. Cl.[7] ..... A63H 17/00

(52) U.S. Cl. ..... 446/14; 106/21

(58) Field of Search ..... 446/14, 219, 465, 446/431, 470, 471; 106/21; 427/148; 428/31

(56) References Cited

U.S. PATENT DOCUMENTS 3,942,285 A * 3/1976 Dehner ..... 446/470
4,142,782 A 3/1979 O'Brian
4,421,560 A * 12/1983 Kito et al. ..... 106/21
4,717,710 A 1/1988 Shimizu et al.

FOREIGN PATENT DOCUMENTS

| | | |
|---|---|---|
| JP | SHO 50-90795 | 7/1979 |
| JP | SHO 60-61088 | 4/1985 |
| WO | WO/ 86/02855 | 5/1986 |

* cited by examiner

*Primary Examiner*—Derris H. Banks

(57) ABSTRACT

A toy vehicle spray painted with paint containing thermochromic material which changes color as the temperature of the vehicle varies. Selected portions of the toy vehicle may be painted with the thermochromic material to provide a variety of patterns, designs, numbers, letters or other indicia which change color in response to temperature variations. In addition, different portions of the toy vehicle may be painted with different paints containing different color thermochromic materials.

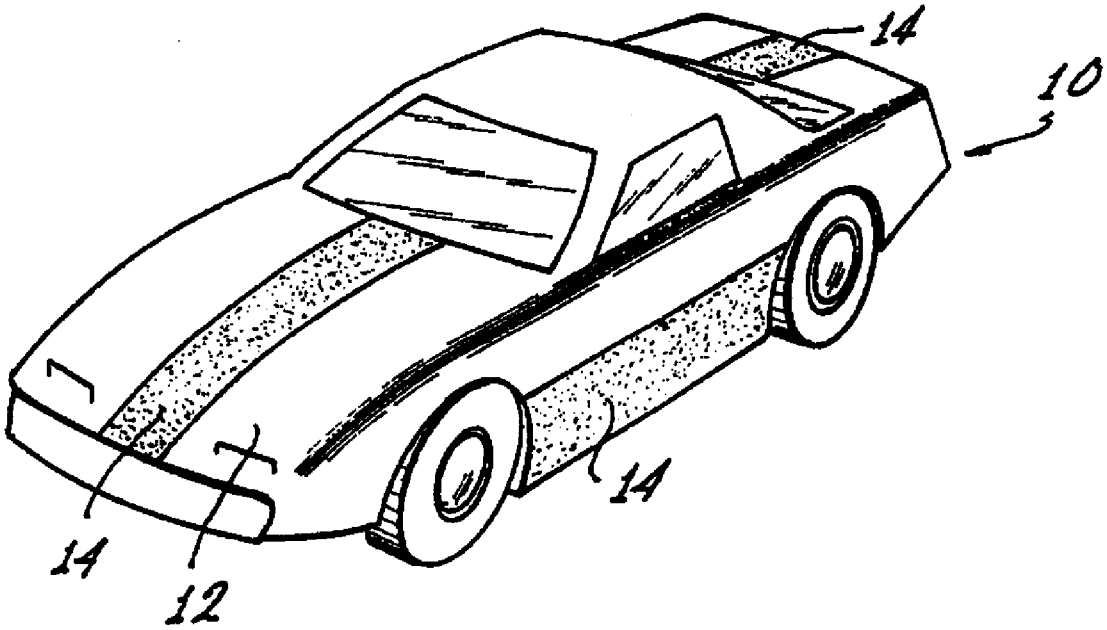

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19 are cancelled.

* * * * *